US011415072B2

(12) United States Patent
Moine et al.

(10) Patent No.: US 11,415,072 B2
(45) Date of Patent: Aug. 16, 2022

(54) METHOD FOR CONTROLLING AN INTERNAL COMBUSTION ENGINE WITH LEARNING OF ATMOSPHERIC PRESSURE

(71) Applicant: VITESCO TECHNOLOGIES GMBH, Hanover (DE)

(72) Inventors: Xavier Moine, Toulouse (FR); Yohan Dupouy, Toulouse (FR)

(73) Assignee: VITESCO TECHNOLOGIES GMBH, Hanover (DE)

( * ) Notice: Subject to any disclaimer, the term of this patent is extended or adjusted under 35 U.S.C. 154(b) by 0 days.

(21) Appl. No.: 17/298,883

(22) PCT Filed: Dec. 4, 2019

(86) PCT No.: PCT/EP2019/083602
§ 371 (c)(1),
(2) Date: Jun. 1, 2021

(87) PCT Pub. No.: WO2020/115098
PCT Pub. Date: Jun. 11, 2020

(65) Prior Publication Data

US 2022/0018303 A1 Jan. 20, 2022

(30) Foreign Application Priority Data

Dec. 4, 2018 (FR) ..... 1872286

(51) Int. Cl.
*F02D 41/24* (2006.01)
*F02D 41/00* (2006.01)
*F02D 41/14* (2006.01)

(52) U.S. Cl.
CPC ..... *F02D 41/2451* (2013.01); *F02D 41/0002* (2013.01); *F02D 41/009* (2013.01);
(Continued)

(58) Field of Classification Search
CPC ..... F02D 2041/1432; F02D 2200/021; F02D 2200/0404; F02D 2200/0406;
(Continued)

(56) References Cited

U.S. PATENT DOCUMENTS 5,720,258 A * 2/1998 Tolkacz ..... F02D 41/1404 123/352
5,918,582 A * 7/1999 Itoyama ..... F02D 9/04 73/114.37
(Continued)

FOREIGN PATENT DOCUMENTS

CN 106226086 12/2016
EP 1 433 944 6/2004
(Continued)

OTHER PUBLICATIONS

International Search Report for PCT/EP2019/083602 dated Feb. 11, 2020, 7 pages.
(Continued)

*Primary Examiner* — Carl C Staubach
(74) *Attorney, Agent, or Firm* — Nixon & Vanderhye

(57) ABSTRACT

A method for controlling an internal combustion engine with a crankshaft position sensor, intake air pressure sensor and fresh air intake throttle valve, includes: determining the engine's rotational speed based on the crankshaft position derivative relative to time; determining the intake air pressure for a first crankshaft position corresponding to 180° before top dead center; determining the intake air pressure for a second crankshaft position corresponding to 390° before top dead center; determining an atmospheric pressure learning pressure threshold based on the engine's rotational speed; determining whether the difference between the intake air pressures for the first and second crankshaft positions is below the atmospheric pressure learning pressure threshold; if so, commanding atmospheric pressure
(Continued)

learning by applying a first-order filter to the intake air pressure for the second crankshaft position; and controlling the internal combustion engine as a function of the learned atmospheric pressure value.

20 Claims, 4 Drawing Sheets

(52) U.S. Cl.
CPC .. *F02D 41/1401* (2013.01); *F02D 2041/1432* (2013.01); *F02D 2200/021* (2013.01); *F02D 2200/0404* (2013.01); *F02D 2200/0406* (2013.01); *F02D 2200/101* (2013.01); *F02D 2200/703* (2013.01)

(58) Field of Classification Search
CPC ..... F02D 2200/101; F02D 2200/703; F02D 2200/704; F02D 2250/14; F02D 41/0002; F02D 41/009; F02D 41/1401; F02D 41/2451
See application file for complete search history.

(56) References Cited

U.S. PATENT DOCUMENTS

| | | | | |
|---|---|---|---|---|
| 6,095,116 | A * | 8/2000 | Matsushita | F02D 41/0005 123/295 |
| 6,244,243 | B1 * | 6/2001 | Mamiya | F02D 41/0002 123/406.51 |
| 6,983,646 | B2 | 1/2006 | Sawada et al. | |
| 7,628,061 | B2 * | 12/2009 | Dingl | F02D 41/0002 73/114.37 |
| 9,027,393 | B2 * | 5/2015 | Hagari | F02D 41/18 73/114.33 |
| 10,697,386 | B2 | 6/2020 | Moine | |
| 2003/0037770 | A1 | 2/2003 | Kishibata et al. | |
| 2004/0244471 | A1 | 12/2004 | Sawada et al. | |
| 2013/0090836 | A1 | 4/2013 | Culbertson et al. | |
| 2018/0347496 | A1 * | 12/2018 | Moine | F02D 41/14 |

FOREIGN PATENT DOCUMENTS

| | | |
|---|---|---|
| EP | 1 447 551 | 8/2004 |
| EP | 1 541 847 | 6/2005 |
| JP | S59-188530 | 10/1984 |
| JP | H06-241106 | 8/1994 |
| JP | H07-34952 | 2/1995 |
| JP | H07-208253 | 8/1995 |
| JP | H08-232749 | 9/1996 |
| JP | 2842763 | 1/1999 |
| JP | 2008-019742 | 1/2008 |
| JP | 2013-083262 | 5/2013 |
| JP | 2015/175284 | 10/2015 |
| JP | 2015-218700 | 12/2015 |
| TW | 200406536 | 5/2004 |
| WO | 2017/097396 | 6/2017 |

OTHER PUBLICATIONS

Written Opinion of the ISA for PCT/EP2019/083602 dated Feb. 11, 2020, 7 pages.

* cited by examiner

METHOD FOR CONTROLLING AN INTERNAL COMBUSTION ENGINE WITH LEARNING OF ATMOSPHERIC PRESSURE

CROSS-REFERENCE TO RELATED APPLICATIONS

This application is the U.S. national phase of International Application No. PCT/EP2019/083602 filed Dec. 4, 2019 which designated the U.S. and claims priority to FR 1872286 filed Dec. 4, 2018, the entire contents of each of which are hereby incorporated by reference.

BACKGROUND OF THE INVENTION

Field of the Invention

The technical field of the invention is that of controlling internal combustion engines, and more particularly, controlling such engines without an intake throttle valve angle sensor.

Description of the Related Art

Controlling an internal combustion engine requires information relating to the engine load, particularly for single-cylinder engines.

At least two items of engine load information are usually used out of the intake throttle valve angle, the intake air pressure and/or the intake air flow rate.

In other embodiments, the intake throttle valve angle is used as the only engine load information. However, in this case, control is not robust in relation to changes in altitude, or requires altitude compensation via a pressure sensor.

Sensors for detecting the intake throttle valve position are difficult to incorporate and are not all reliable over time, particularly in the case of brush sensors (electrical wishers).

Document JP07034952A is known from the prior art, and describes a method for controlling an internal combustion engine comprising the detection of the opening state of the sensor for detecting the intake throttle valve position. The document discloses taking into account changes in altitude in order to compensate for the quantity of intake air as a function of the measured position of the sensor for detecting the intake throttle valve position.

However, the teachings disclosed in this document involve determining the atmospheric pressure only when the engine is switched off. Such determination does not make it possible to differentiate between the incorrect estimation of atmospheric pressure and variation in components.

There is therefore a problem relating to controlling an engine that does not use a sensor for detecting the position of the intake throttle valve making it possible to address problems linked to variation in components and the incorrect estimation of atmospheric pressure.

SUMMARY OF THE INVENTION

The invention relates to a method for controlling an internal combustion engine provided with a crankshaft position sensor, an intake air pressure sensor and a fresh air intake throttle valve, comprising the following steps:

- determining the rotational speed of the internal combustion engine as a function of the derivative of the crankshaft position in relation to time,
- determining the intake air pressure for a first crankshaft position corresponding to 180° before top dead center,

- determining the intake air pressure for a second crankshaft position corresponding to 390° before top dead center,
- determining an atmospheric pressure learning pressure threshold as a function of the rotational speed of the internal combustion engine,
- determining whether the difference between the intake air pressure for the first crankshaft position and the intake air pressure for the second crankshaft position is below the atmospheric pressure learning pressure threshold,
- if so, commanding atmospheric pressure learning by applying a first-order filter to the intake air pressure for the second crankshaft position, and
- controlling the internal combustion engine as a function of the learned atmospheric pressure value, and in which, as the internal combustion engine is provided with an air intake bypass valve, the following steps are carried out:

- determining a pressure ratio by dividing the intake air pressure for the second crankshaft position by the learned atmospheric pressure value,
- determining whether the internal combustion engine is running or has been operating for at least a predetermined period,
- if so, determining whether the air intake bypass valve is open,
- determining a base value of a pressure ratio threshold as a function of the rotational speed of the internal combustion engine and the state of the air intake bypass valve,
- determining an adjusted value of the pressure ratio threshold as a function of the base value of the pressure ratio threshold, an adjustment value and the state of the air intake bypass valve,
- determining whether the pressure ratio is below the adjusted value of the pressure ratio threshold,
- if so, determining that the air intake throttle valve is closed,
- if not, determining that the air intake throttle valve is open, and
- controlling the internal combustion engine as a function of the state of the air intake throttle valve.

In order to determine the learned atmospheric pressure value for an occurrence, when the occurrence is strictly greater than the first occurrence, a corrective value can be determined by applying a first-order filter to the difference between the intake air pressure value for a second crankshaft position for the current occurrence and the learned atmospheric pressure value for the preceding occurrence, and the corrective value can be added to a learned atmospheric pressure value for the preceding occurrence.

In order to determine the learned atmospheric pressure value for the first occurrence, a corrective value can be determined by applying a first-order filter to the difference between the intake air pressure value for a second crankshaft position for the current occurrence and a stored atmospheric pressure value, and the corrective value can be added to the stored atmospheric pressure value.

A hysteresis offset value can be added to and/or subtracted from the adjusted value of the pressure ratio threshold, so as to avoid oscillation between an open and closed detected state of the fresh air intake throttle valve.

As the internal combustion engine can be provided with an electronic control unit, the following steps can be carried out:

setting the adjustment value of the pressure ratio threshold to a value stored on shutdown of the electronic control unit, determining whether a set of conditions has a first value, if so, determining a base value of the pressure ratio threshold by means of mapping predetermined as a function of the rotational speed of the internal combustion engine, determining whether the pressure ratio is below the sum of the base value of the pressure ratio threshold and the stored adjustment value of the pressure ratio threshold, if so, determining the adjustment value of the pressure ratio threshold for the current occurrence by subtracting the adjusted value of the pressure ratio threshold stored in the electronic control unit from the first-order filtered value of the pressure ratio, then storing the adjustment value of the pressure ratio threshold in the electronic control unit.

On a first waking of the electronic control unit, the adjustment value can be set to a predetermined constant value.

In order to determine that the set of conditions has a first value, it can be determined whether each of the conditions in the set has a first value, the set of conditions comprising:

a first condition having a first value if the internal combustion engine has been operating for at least a minimum duration, a second condition having a first value if the temperature of the internal combustion engine is greater than a minimum temperature and less than a maximum temperature, a third condition having a first value if no errors are determined on the sensors and actuators, a fourth condition having a first value if the rotational speed of the internal combustion engine is greater than a minimum rotational speed and less than a maximum rotational speed.

After the adjusted value of the pressure ratio threshold has been stored, or when the pressure ratio is greater than the sum of the base value of the pressure ratio threshold and the stored adjustment value of the pressure ratio threshold, or when the set of conditions has a second value, it can be determined whether the electronic control unit is shut down following a shutdown request from the driver, if so, the method can return to the setting of the adjustment value of the pressure ratio threshold, and if not, the method can return to the determining of the value of a set of conditions.

As the internal combustion engine can be provided with an electronic control unit, the deviation of the adjustment between maximum and minimum values of the pressure ratio threshold can be limited by limiting the adjustment values stored when the electronic control unit is switched off compared to those stored when the electronic control unit wakes up.

Such a control method has the advantage of robust control in relation to failures or the removal of the sensor for detecting the position of the intake throttle valve.

BRIEF DESCRIPTION OF THE DRAWINGS

Further aims, features and advantages of the invention will become apparent on reading the following description, which is given solely by way of non-limiting example, and with reference to the appended drawings, in which.

DESCRIPTION OF THE PREFERRED EMBODIMENTS

The atmospheric pressure learning will now be described.

In order to eliminate the need for a sensor for detecting the position of the intake throttle valve, the intake throttle valve position information is replaced by intake air pressure information.

Two acquisitions are then carried out per combustion cycle, a first acquisition MAP taken in a first angular position of the crankshaft equal to 180° BTDC (Before Top Dead Center), and a second acquisition MAP_UP taken in a second angular position of the crankshaft equal to 390° BTDC.

A pressure ratio PQ_AMP is then defined that makes it possible to determine the closure of the intake throttle valve:

$$PQ_AMP = MAP/AMP \quad \text{(Eq. 1)}$$

Where AMP is the learned atmospheric pressure value.

Atmospheric pressure learning is carried out when the difference between the intake air pressure measurement MAP taken in the first angular position and the intake air pressure measurement MAP_UP in the second angular position is below a pressure threshold ΔP. Equation Eq. 2 illustrates this condition.

$$\Delta P < MAP_UP - MAP \quad \text{(Eq. 2)}$$

Figure 1:
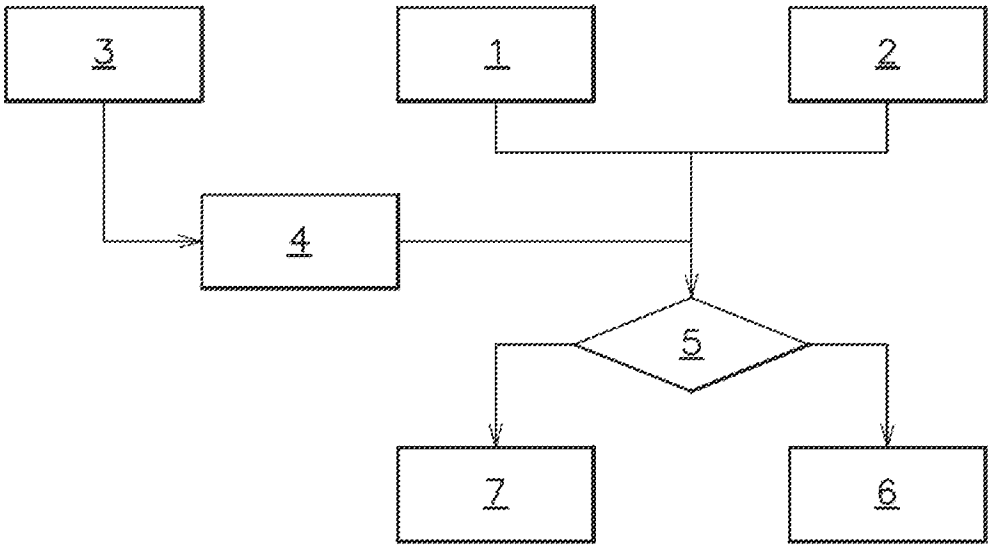
FIG. 1 illustrates the main steps of a method for controlling an internal combustion engine controlled as a function of the intake air pressure.

FIG. 1 shows the main steps of a method for controlling an internal combustion engine controlled as a function of the intake air pressure.

For a current occurrence denoted as n, the following steps are carried out. If the current occurrence n is the first occurrence, the learned atmospheric pressure value $AMP_n$ is set to a stored atmospheric pressure value. The stored atmospheric pressure value can be the learned atmospheric pressure value on the preceding shutdown of the electronic control unit of the internal combustion engine, or a predetermined value, for example standard atmospheric pressure.

The following steps are then carried out.

During a first step 1, the intake air pressure $MAP_n$ for a first crankshaft position corresponding to 180° before top dead center (BTDC) is determined.

During a second step 2, the intake air pressure $MAP_UP_n$ for a second crankshaft position corresponding to 390° before top dead center (BTDC) is determined.

During a third step 3, the rotational speed of the internal combustion engine is determined then, during a fourth step 4, an atmospheric pressure learning pressure threshold $\Delta P_n$ is determined as a function of the rotational speed of the internal combustion engine.

Figure 4:
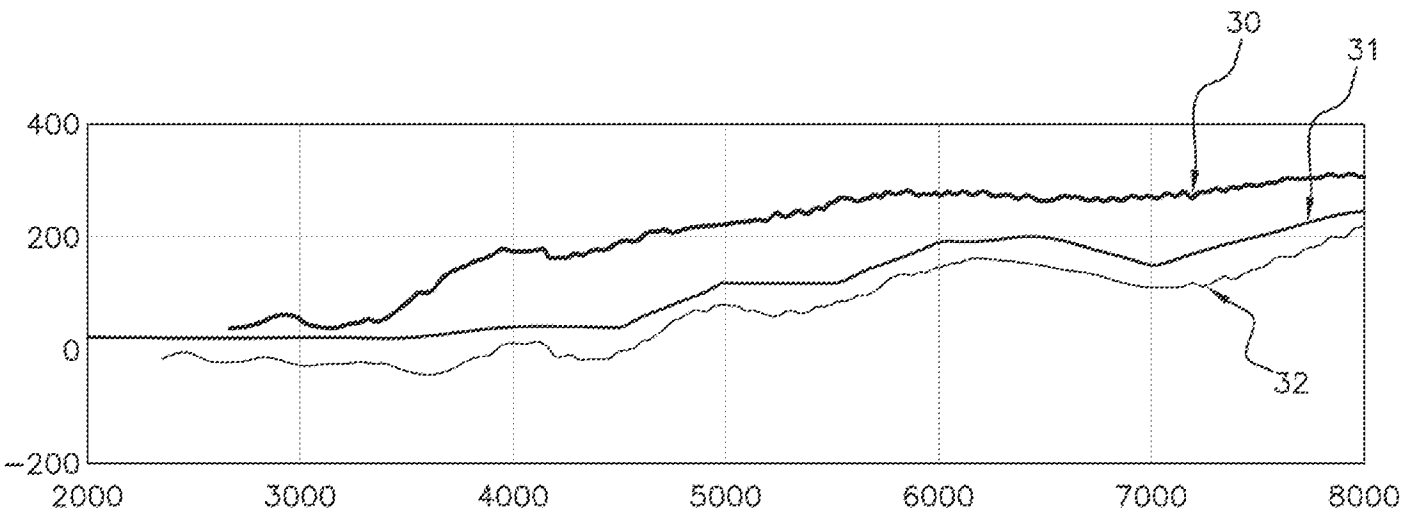
FIG. 4 illustrates an example of the change in the atmospheric pressure learning pressure threshold as a function of the rotational speed of the engine.

FIG. 4 shows the change in the atmospheric pressure learning threshold $\Delta P_n$ as a function of the rotational speed of the engine: it can be seen that this learning threshold $\Delta P_n$ adopts the form of a curve 31 that rises with the number of engine revolutions, the upper and lower values respectively of this curve 31 being framed between two values defined by two other curves 30, 32 as set out below:

An upper curve 30 of learning pressure threshold $\Delta P_n$ values, which is obtained for example with a median opening of the gas throttle valve; and A lower curve 32 of learning pressure threshold $\Delta P_n$ values, which is obtained with a wide opening of the gas throttle valve.

The learning pressure threshold $\Delta P_n$ values that are above the upper curve 30 and below the lower curve 32 must be rejected for atmospheric pressure learning. The atmospheric pressure learning pressure threshold $\Delta P_n$ must therefore be situated between these two values for a given rotational speed of the engine, preferably closer to the lower curve 32 than to the upper curve 30.

Preferably, the learning pressure threshold $\Delta P_n$ is situated in a range of values within the first third of values above the lower curve 32 for a complete range of values equal to 1 between the two upper 30 and lower 32 curves.

"Wide opening" of the throttle valve is preferably given to mean the maximum opening of the throttle valve.

These learning threshold values are for example calibrated for a given engine, and saved in the form of a map/table in the electronic control unit of the internal combustion engine.

During a fifth step 5, it is determined whether the difference between the intake air pressures $MAP_UP_n$ and $MAP_n$ is below the atmospheric pressure learning pressure threshold $\Delta P_n$.

If not, the control method continues with a sixth step 6, during which the command is given not to carry out atmospheric pressure learning. The learned atmospheric pressure value $AMP_n$ of the current occurrence is then kept equal to the learned atmospheric pressure value $AMP_{n-1}$ of the preceding occurrence.

If the difference between the intake air pressures $MAP_UP_n$ and $MAP_n$ is below the atmospheric pressure learning threshold $\Delta P_n$, the method continues with a seventh step 7 during which the atmospheric pressure learning command is given.

The learned atmospheric pressure value $AMP_n$ for the current occurrence is obtained by adding a corrective value to the learned atmospheric pressure value $AMP_{n-1}$ for the preceding occurrence. The corrective value is determined by applying a first-order filter to the difference between the intake air pressure value $MAP_UP_n$ for a second crankshaft position for the current occurrence and the learned atmospheric pressure value $AMP_{n-1}$ for the preceding occurrence. The intake air pressure $MAP_UP_n$ for the second crankshaft position is considered to correspond substantially to atmospheric pressure due to the pressure in the intake manifold.

$$AMP_n = AMP_{n-1} + C_AMP_MMV_CRLC * (MAP_UP - AMP_{n-1} + IP_AMP_N) \quad \text{(Eq. 3)}$$

Where:

$AMP_n$ is the learned atmospheric pressure value for the current occurrence, $AMP_{n-1}$ is the learned atmospheric pressure value for the preceding occurrence, C_AMP_MMV_CRLC is a coefficient of the first-order filter, $MAP_UP_n$ is the intake air pressure MAP_UP for a second crankshaft position corresponding to 390° for the current occurrence, IP_AMP_N is an offset value.

Figure 2:
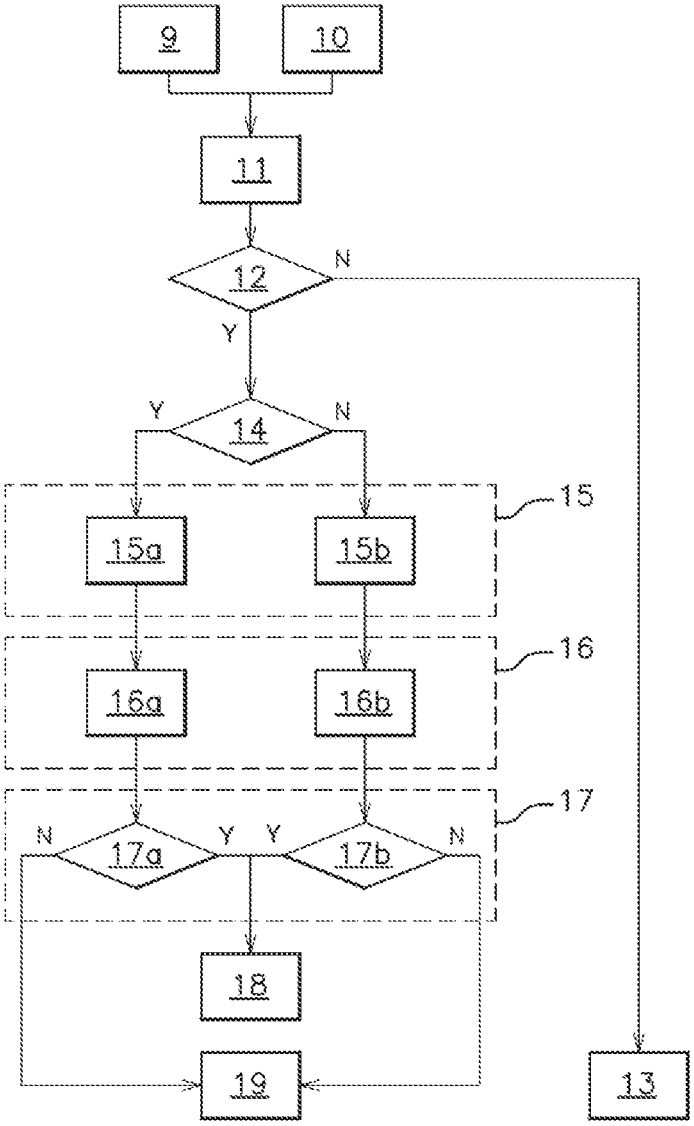
FIG. 2 illustrates the main steps of a method for determining the closure of the fresh air intake throttle valve.

FIG. 2 shows the main steps of a method for determining the closure of the fresh air intake throttle valve.

During a first step 9, the intake air pressure $MAP_n$ for a first crankshaft position corresponding to 180° before top dead center (BTDC) is determined. Alternatively, this value is known from the second step 2 of the method for controlling an internal combustion engine illustrated by FIG. 1.

During a second step 10, the learned atmospheric pressure value $AMP_n$ is determined by application of steps 1 to 6 of the method for controlling an internal combustion engine illustrated by FIG. 1.

During a third step 11, a pressure ratio $PQ_AMP_n$ is determined by dividing the intake air pressure $MAP_n$ for a crankshaft position corresponding to 180° before top dead center (BTDC) by the learned atmospheric pressure value $AMP_n$.

During a fourth step 12, it is determined whether the internal combustion engine is running or has been operating for at least a predetermined duration.

If not, the method is interrupted at a fifth step 13.

If so, the method continues to a sixth step 14, during which it is determined whether an air intake bypass valve is open. The air intake bypass valve is positioned in an air intake duct connected in parallel with the main air intake duct. The bypass valve is an on/off valve that makes it possible to control the quantity of air taken into the engine. The bypass valve is controlled solely by the engine control system, while the fresh air intake throttle valve is controlled by the user. The bypass valve makes it possible to convey more air to the engine, and makes it possible for example to keep the engine idling when the engine is cold.

The method then continues with steps 15, 15a, 15b of determining a base value of the pressure ratio threshold PQ_AMP_CT_BAS as a function of the rotational speed of the internal combustion engine and the state of the air intake bypass valve.

The method then continues with steps 16, 16a, 16b of determining an adjusted value of the pressure ratio threshold PQ_AMP_CT as a function of the base value of the pressure ratio threshold PQ_AMP_CT_BAS, an adjustment value $PQ_AMP_CT_AD_n$ and the state of the air intake bypass valve.

Then, during steps 17, 17a, 17b, it is determined whether the pressure ratio $PQ_AMP_n$ is greater than the adjusted value of the pressure ratio threshold PQ_AMP_CT in order to conclude that the closed state of the air intake throttle valve is detected in step 18 or that the open state is detected in step 19.

More specifically, if it was determined in step 14 that the air intake bypass valve is open, the method continues with a seventh step 15a, during which a base value of the pressure ratio threshold PQ_AMP_CT_BAS_ECK_ON when the air intake bypass valve is open is determined, on the basis of mapping as a function of the rotational speed of the internal combustion engine.

In a particular embodiment, the method continues with an eighth step 16a during which an adjusted value of the pressure ratio threshold PQ_AMP_CT_ECK_ON when the air intake bypass valve is open is determined by applying the following equation:

$$PQ_AMP_CT_ECK_ON = PQ_AMP_CT_BAS_ECK_ON + PQ_AMP_CT_AD_n \quad \text{(Eq. 4)}$$

Where $PQ_AMP_CT_AD_n$ is a pressure ratio adjustment value.

In all of the embodiments, the method continues with a ninth step 17a, during which it is determined whether the pressure ratio $PQ_AMP_n$ is greater than the adjusted value of the pressure ratio threshold PQ_AMP_CT_ECK_ON when the air intake bypass valve is open.

If so, it is determined that the fresh air intake throttle valve is closed during a tenth step 18.

If not, it is determined that the fresh air intake throttle valve is open during an eleventh step 19.

If it was determined in step 14 that the air intake bypass valve is closed, the method continues with a twelfth step 15b, during which a base value of the pressure ratio threshold PQ_AMP_CT_BAS_ECK_OFF when the air intake bypass valve is closed is determined, on the basis of mapping as a function of the rotational speed of the internal combustion engine.

In a particular embodiment, the method continues with a thirteenth step 16b during which an adjusted value of the pressure ratio threshold PQ_AMP_CT_ECK_OFF when the air intake bypass valve is closed is determined, by applying the following equation resulting from Eq. 4:

$$PQ_AMP_CT_ECK_OFF = PQ_AMP_CT_BAS_ECK_OFF + PQ_AMP_CT_AD_n \quad \text{(Eq. 5)}$$

During a fourteenth step 17b, it is determined whether the pressure ratio $PQ_AMP_n$ is less than the adjusted value of the pressure ratio threshold PQ_AMP_CT_ECK_OFF when the air intake bypass valve is closed.

If so, it is determined that the fresh air intake throttle valve is closed during a tenth step 18.

If not, it is determined that the fresh air intake throttle valve is open during an eleventh step 19.

In an alternative embodiment, a hysteresis offset value is added to and/or subtracted from the adjusted value of the pressure ratio threshold determined following the eighth step 16a or the thirteenth step 16b, so as to avoid oscillation between an open and closed detected state of the fresh air intake throttle valve.

Figure 3:
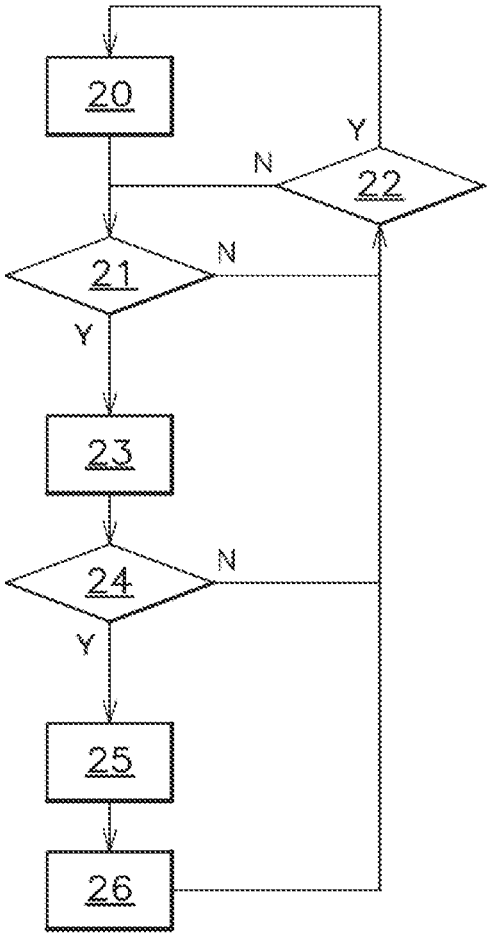
FIG. 3 illustrates the main steps of determining the adjustment value of the pressure ratio threshold for determining the closure of the fresh air intake throttle valve.

FIG. 3 shows the main steps of determining the adjustment value $PQ_AMP_CT_AD_n$ of the pressure ratio threshold for determining the closed or open state of the fresh air intake throttle valve carried out during the eighth step 16a or the thirteenth step 16b.

For a current occurrence, the following steps are carried out.

During a first step 20, the adjustment value $PQ_AMP_CT_AD_n$ of the pressure ratio threshold is set to a value stored on shutdown of the electronic control unit. In the case of a first waking, the adjustment value is set to a predetermined constant value C_PQ_AMP_CT_AD_UP.

During a second step 21, it is determined whether a set of conditions has a first value.

A first condition of the set of conditions has a first value if the internal combustion engine has been operating for at least a minimum duration.

A second condition of the set of conditions has a first value if the temperature of the internal combustion engine is greater than a minimum temperature and less than a maximum temperature.

A third condition of the set of conditions has a first value if no errors are determined on the sensors and actuators.

A fourth condition of the set of conditions has a first value if the rotational speed of the internal combustion engine is greater than a minimum rotational speed and less than a maximum rotational speed.

The conditions of the set of conditions are combined together by means of AND logical operators. The set of conditions thus has a first value if each condition has a first value. The set of conditions has a second value if at least one condition has a second value.

If not, the method continues with a third step 22, during which it is determined whether the electronic control unit is shut down following a KEY_OFF shutdown request from the driver.

If so, the method returns to the first step 20.

If not, the method returns to the second step 21.

If, during a second step 21, it was determined that the set of conditions has a first value, the method continues with a fourth step 23, during which a base value of the pressure ratio threshold PQ_AMP_CT_BAS is determined by means of mapping predetermined as a function of the rotational speed of the internal combustion engine. This value is also determined during steps 15a, 15b of the method for determining the open or closed state of the fresh air intake throttle valve.

During a fifth step 24, it is determined whether the pressure ratio $PQ_AMP_n$ determined in the third step 11 of the method for determining the closure of the fresh air intake throttle valve is less than the sum of the base value of the pressure ratio threshold PQ_AMP_CT_BAS and the adjustment value $PQ_AMP_CT_AD_n$ of the stored pressure ratio threshold.

If not, the method continues with the third step 22.

If so, the method continues with a sixth step 25, during which the adjustment value $PQ_AMP_CT_AD_n$ of the pressure ratio threshold for the current occurrence is determined by subtracting the adjustment value of the pressure ratio threshold $PQ_AMP_CT_AD_{n-1}$ determined on the preceding occurrence and stored in the electronic control unit of the first-order filtered value from the pressure ratio $PQ_AMP_n$ and by adding an offset value to the total.

The offset value is strictly greater than the value PQ_AMP_CT_BAS_ECK_ON or the value PQ_AMP_CT_BAS_ECK_OFF when the step is included respectively in the eighth step 16a or in the thirteenth step 16b in order to allow the detection of the closed throttle valve.

The first-order filter comprises a positive filtering coefficient and a negative filtering coefficient that are different in order to obtain faster learning towards the low values than towards the high values. The high values correspond to a plausible situation in which the throttle valve is very slightly open.

The deviation of the adjustment is limited between maximum and minimum values of the pressure ratio threshold by limiting the adjustment values stored when the electronic control unit is switched off compared to those stored when the electronic control unit wakes up.

Preceding occurrence is understood to mean the adjustment value of the pressure ratio threshold $PQ_AMP_CT_AD_n$ stored in the electronic control unit or set by the electronic control unit.

During a seventh step 26, the adjustment value of the threshold $PQ_AMP_CT_AD_n$ is stored in the electronic control unit.

The method then continues with the third step 22.

The invention claimed is:

1. A method for controlling an internal combustion engine provided with a crankshaft position sensor, an intake air pressure sensor and a fresh air intake throttle valve, comprising the following steps:

determining the rotational speed of the internal combustion engine as a function of the derivative of the crankshaft position in relation to time, determining the intake air pressure for a first crankshaft position corresponding to 180° before top dead center, determining the intake air pressure for a second crankshaft position corresponding to 390° before top dead center, determining an atmospheric pressure learning pressure threshold as a function of the rotational speed of the internal combustion engine, determining whether the difference between the intake air pressure for the first crankshaft position and the intake air pressure for the second crankshaft position is below the atmospheric pressure learning pressure threshold, if so, commanding atmospheric pressure learning by applying a first-order filter to the intake air pressure for the second crankshaft position, and controlling the internal combustion engine as a function of the learned atmospheric pressure value, and in which, as the internal combustion engine is provided with an air intake bypass valve, the following steps are carried out:

determining a pressure ratio by dividing the intake air pressure for the second crankshaft position by the learned atmospheric pressure value, determining whether the internal combustion engine is running or has been operating for at least a predetermined duration, if so, determining whether the air intake bypass valve is open, determining a base value of a pressure ratio threshold as a function of the rotational speed of the internal combustion engine and the state of the air intake bypass valve, determining an adjusted value of the pressure ratio threshold as a function of the base value of the pressure ratio threshold, an adjustment value and the state of the air intake bypass valve, determining whether the pressure ratio is below the adjusted value of the pressure ratio threshold, if so, determining that the air intake throttle valve is closed, if not, determining that the air intake throttle valve is open, and controlling the internal combustion engine as a function of the state of the air intake throttle valve.

2. The method as claimed in claim 1, wherein, in order to determine the learned atmospheric pressure value for an occurrence, when the occurrence is strictly greater than the first occurrence, a corrective value is determined by applying a first-order filter to the difference between the intake air pressure value for a second crankshaft position for the current occurrence and the learned atmospheric pressure value for the preceding occurrence, the corrective value is added to the learned atmospheric pressure value for the preceding occurrence.

3. The method as claimed in claim 1, wherein, in order to determine the learned atmospheric pressure value for the first occurrence, a corrective value is determined by applying a first-order filter to the difference between the intake air pressure value for a second crankshaft position for the current occurrence and a stored atmospheric pressure value, and the corrective value is added to the stored atmospheric pressure value.

4. The control method as claimed in claim 1, wherein, a hysteresis offset value is added to and/or subtracted from the adjusted value of the pressure ratio threshold, so as to avoid oscillation between an open and closed detected state of the fresh air intake throttle valve.

5. The control method as claimed in claim 1, wherein, as the internal combustion engine is provided with an electronic control unit, the following steps are carried out:

setting the adjustment value of the pressure ratio threshold to a value stored on shutdown of the electronic control unit, determining whether a set of conditions has a first value, if so, determining a base value of the pressure ratio threshold by means of mapping predetermined as a function of the rotational speed of the internal combustion engine, determining whether the pressure ratio is less than the sum of the base value of the pressure ratio threshold and the stored adjustment value of the pressure ratio threshold, if so, determining the adjustment value of the pressure ratio threshold for the current occurrence by subtracting the adjusted value of the pressure ratio threshold stored in the electronic control unit from the first-order filtered value of the pressure ratio, then storing the adjustment value of the pressure ratio threshold in the electronic control unit.

6. The control method as claimed in claim 5, wherein, on a first waking of the electronic control unit, the adjustment value is set to a predetermined constant value.

7. The control method as claimed in claim 5, wherein, in order to determine that the set of conditions has a first value, it is determined whether each of the conditions in the set has a first value, the set of conditions comprising:

a first condition having a first value if the internal combustion engine has been operating for at least a minimum duration, a second condition having a first value if the temperature of the internal combustion engine is greater than a minimum temperature and less than a maximum temperature, a third condition having a first value if no errors are determined on the sensors and actuators, a fourth condition having a first value if the rotational speed of the internal combustion engine is greater than a minimum rotational speed and less than a maximum rotational speed.

8. The control method as claimed in claim 5, wherein, after the adjusted value of the pressure ratio threshold has been stored, or when the pressure ratio is greater than the sum of the base value of the pressure ratio threshold and the stored adjustment value of the pressure ratio threshold, or when the set of conditions has a second value, it is determined whether the electronic control unit is shut down following a shutdown request from the driver, if so, the method returns to the setting of the adjustment value of the pressure ratio threshold, and if not, the method returns to the determining of the value of a set of conditions.

9. The control method as claimed in claim 1, wherein, as the internal combustion engine is provided with an electronic control unit, the deviation of the adjustment between maximum and minimum values of the pressure ratio threshold is limited by limiting the adjustment values stored when the electronic control unit is switched off compared to those stored when the electronic control unit wakes up.

10. The control method as claimed in claim 2, wherein a hysteresis offset value is added to and/or subtracted from the adjusted value of the pressure ratio threshold, so as to avoid oscillation between an open and closed detected state of the fresh air intake throttle valve.

11. The control method as claimed in claim 3, wherein a hysteresis offset value is added to and/or subtracted from the adjusted value of the pressure ratio threshold, so as to avoid oscillation between an open and closed detected state of the fresh air intake throttle valve.

12. The control method as claimed in claim 2, wherein, as the internal combustion engine is provided with an electronic control unit, the following steps are carried out:

setting the adjustment value of the pressure ratio threshold to a value stored on shutdown of the electronic control unit, determining whether a set of conditions has a first value, if so, determining a base value of the pressure ratio threshold by means of mapping predetermined as a function of the rotational speed of the internal combustion engine, determining whether the pressure ratio is less than the sum of the base value of the pressure ratio threshold and the stored adjustment value of the pressure ratio threshold, if so, determining the adjustment value of the pressure ratio threshold for the current occurrence by subtracting the adjusted value of the pressure ratio threshold stored in the electronic control unit from the first-order filtered value of the pressure ratio, then storing the adjustment value of the pressure ratio threshold in the electronic control unit.

13. The control method as claimed in claim 3, wherein, as the internal combustion engine is provided with an electronic control unit, the following steps are carried out:

setting the adjustment value of the pressure ratio threshold to a value stored on shutdown of the electronic control unit, determining whether a set of conditions has a first value, if so, determining a base value of the pressure ratio threshold by means of mapping predetermined as a function of the rotational speed of the internal combustion engine, determining whether the pressure ratio is less than the sum of the base value of the pressure ratio threshold and the stored adjustment value of the pressure ratio threshold, if so, determining the adjustment value of the pressure ratio threshold for the current occurrence by subtracting the adjusted value of the pressure ratio threshold stored in the electronic control unit from the first-order filtered value of the pressure ratio, then storing the adjustment value of the pressure ratio threshold in the electronic control unit.

14. The control method as claimed in claim 4, wherein, as the internal combustion engine is provided with an electronic control unit, the following steps are carried out:

setting the adjustment value of the pressure ratio threshold to a value stored on shutdown of the electronic control unit, determining whether a set of conditions has a first value, if so, determining a base value of the pressure ratio threshold by means of mapping predetermined as a function of the rotational speed of the internal combustion engine, determining whether the pressure ratio is less than the sum of the base value of the pressure ratio threshold and the stored adjustment value of the pressure ratio threshold, if so, determining the adjustment value of the pressure ratio threshold for the current occurrence by subtracting the adjusted value of the pressure ratio threshold stored in the electronic control unit from the first-order filtered value of the pressure ratio, then storing the adjustment value of the pressure ratio threshold in the electronic control unit.

15. The control method as claimed in claim 6, wherein, in order to determine that the set of conditions has a first value, it is determined whether each of the conditions in the set has a first value, the set of conditions comprising:

a first condition having a first value if the internal combustion engine has been operating for at least a minimum duration, a second condition having a first value if the temperature of the internal combustion engine is greater than a minimum temperature and less than a maximum temperature, a third condition having a first value if no errors are determined on the sensors and actuators, a fourth condition having a first value if the rotational speed of the internal combustion engine is greater than a minimum rotational speed and less than a maximum rotational speed.

16. The control method as claimed in claim 6, wherein, after the adjusted value of the pressure ratio threshold has been stored, or when the pressure ratio is greater than the sum of the base value of the pressure ratio threshold and the stored adjustment value of the pressure ratio threshold, or when the set of conditions has a second value, it is determined whether the electronic control unit is shut down following a shutdown request from the driver, if so, the method returns to the setting of the adjustment value of the pressure ratio threshold, and if not, the method returns to the determining of the value of a set of conditions.

17. The control method as claimed in claim 7, wherein, after the adjusted value of the pressure ratio threshold has been stored, or when the pressure ratio is greater than the sum of the base value of the pressure ratio threshold and the stored adjustment value of the pressure ratio threshold, or when the set of conditions has a second value, it is determined whether the electronic control unit is shut down following a shutdown request from the driver, if so, the method returns to the setting of the adjustment value of the pressure ratio threshold, and if not, the method returns to the determining of the value of a set of conditions.

18. The control method as claimed in claim 2, wherein, as the internal combustion engine is provided with an electronic control unit, the deviation of the adjustment between maximum and minimum values of the pressure ratio threshold is limited by limiting the adjustment values stored when the electronic control unit is switched off compared to those stored when the electronic control unit wakes up.

19. The control method as claimed in claim 3, wherein, as the internal combustion engine is provided with an electronic control unit, the deviation of the adjustment between maximum and minimum values of the pressure ratio threshold is limited by limiting the adjustment values stored when the electronic control unit is switched off compared to those stored when the electronic control unit wakes up.

20. The control method as claimed in claim 4, wherein, as the internal combustion engine is provided with an electronic control unit, the deviation of the adjustment between maximum and minimum values of the pressure ratio threshold is limited by limiting the adjustment values stored when the electronic control unit is switched off compared to those stored when the electronic control unit wakes up.

* * * * *